United States Patent [19]

Stewart et al.

[11] 4,276,241

[45] Jun. 30, 1981

[54] DISPENSER-LIQUID WATER TREATMENT FOR ROOM HUMIDIFIER

[75] Inventors: Richard F. Stewart, North Brunswick; Robert W. Kennedy, Bridgewater, both of N.J.

[73] Assignee: White-Westinghouse Corporation, Pittsburgh, Pa.

[21] Appl. No.: 920,460

[22] Filed: Jun. 29, 1978

[51] Int. Cl.[3] ..... B01F 3/04

[52] U.S. Cl. ..... 261/92; 222/162; 261/DIG. 46

[58] Field of Search ..... 261/92, 71, DIG. 15, 261/DIG. 17, DIG. 46; 222/162, 501, 509, 518, 206

[56] References Cited

U.S. PATENT DOCUMENTS

| | | | |
|---|---|---|---|
| 1,256,434 | 2/1918 | Bozzella | 222/162 X |
| 2,367,031 | 1/1945 | Johnson, Jr. | 222/162 X |
| 2,575,124 | 11/1951 | Pollitt | 222/162 |
| 2,709,522 | 5/1955 | Osborne | 261/DIG. 46 |
| 2,859,766 | 11/1958 | Shuldener | 261/DIG. 46 |
| 3,081,004 | 3/1963 | Laughlin et al. | 222/162 X |
| 3,109,558 | 11/1963 | Yetter | 222/162 X |
| 3,126,427 | 3/1964 | Broughton | 261/DIG. 46 |
| 3,421,667 | 1/1969 | Stiteler | 222/509 X |
| 3,430,823 | 3/1969 | Hunsaker | 261/DIG. 46 |
| 4,112,015 | 9/1978 | Tinsler | 261/92 |

*Primary Examiner*—Richard L. Chiesa

*Attorney, Agent, or Firm*—LeBlanc, Nolan, Shur & Nies

[57] ABSTRACT

A humidifier unit with a water supply reservoir, a media unit which passes through the reservoir and picks up moisture, a motor and fan unit together with drive mechanism for rotating the media unit and for blowing air through the media unit and into the surrounding area, and a removable, refillable liquid water treatment dispenser. As depicted, the humidifier is a console room humidifier with the water reservoir accessible from the rear. The removable dispenser is an auxiliary unit consisting of an elongate bottle, the cap of which carries a spring biased poppet valve with a projecting stem. The bottle is inverted and received through an opening in the top wall of the humidifier with its valve operating stem resting on an abutment above a flow passage funnel unit mounted on structure within the humidifier above the water reservoir. The dispenser, when in place, can be pressed down against the biasing force of the spring biased poppet valve, causing the valve to open and dispense a selected amount of treatment fluid such as an anti-liming composition into the water reservoir.

16 Claims, 15 Drawing Figures

FIG. 5
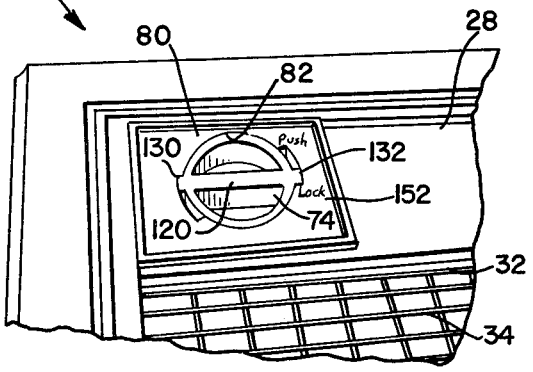
FIG. 6
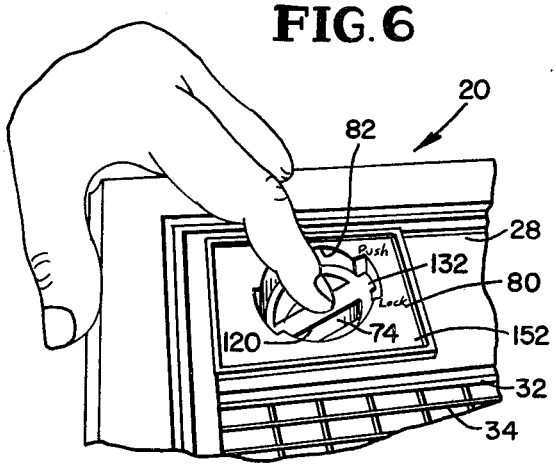
FIG. 7
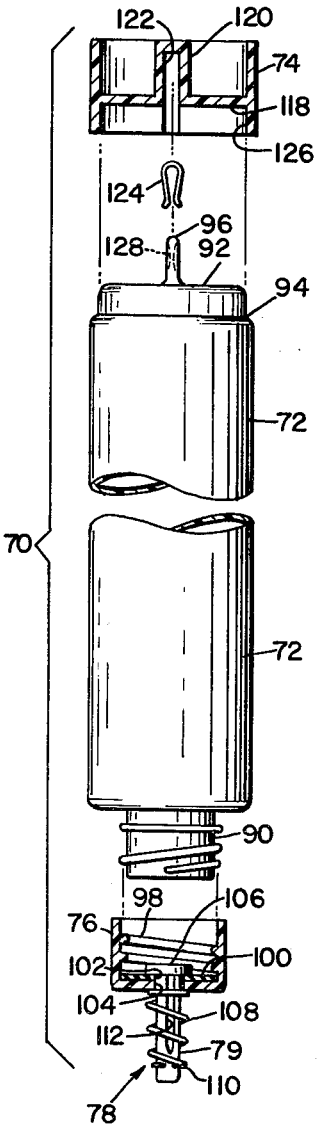
FIG. 8
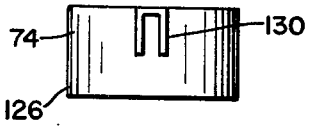
FIG. 9
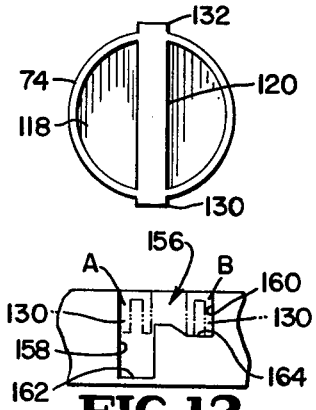
FIG. 10
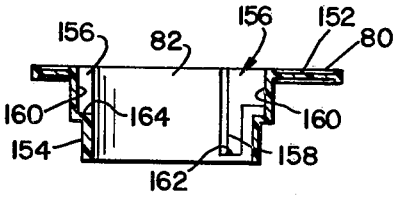
FIG. 11
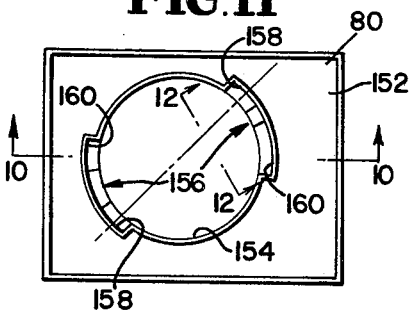
FIG. 12
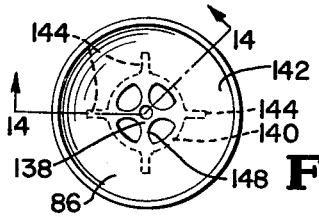
FIG. 13
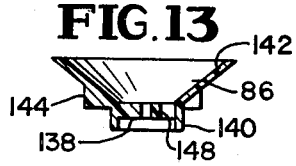
FIG. 14
FIG. 15
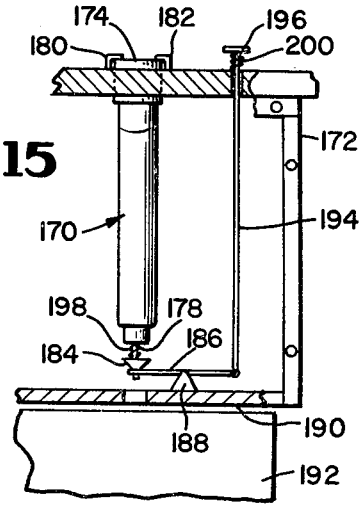

DISPENSER-LIQUID WATER TREATMENT FOR ROOM HUMIDIFIER

BACKGROUND OF THE INVENTION

In most room humidifiers in many areas, the container for the water and the media unit become encrusted with mineral deposits from the water supply. To applicant's knowledge there have been several prior attempted solutions to eliminate this problem in room humidifiers, one of which is periodic addition of anti-liming tablets, and another is addition of a liquid anti-liming solution which can be poured into the water reservoir but those are not wholly satisfactory because they require the home owner to periodically obtain the material from storage and either place a tablet or manually pour a certain amount of solution from a bottle into the water reservoir. A somewhat better arrangement is shown in U.S. Pat. No. 3,323,784 to P. A. Fazio, who discloses in a room humidifier, the use of a second reservoir fixed internally of the humidifier and used to continuously meter an additive liquid such as a deodorant or medicated liquid to the water reservoir. For obvious reasons, continuous metering of an anti-mineral material to a console humidifier would be wasteful and unsatisfactory.

The same problem occurs in the water reservoir of central humidifier apparatus and evaporative cooler installations and, again, solutions to the problem include adding anti-mineral tablets either directly to the water reservoir or to a water supply line as in U.S. Pat. No. 3,191,915 to G. Goettl; or dissolving such tablets in an auxiliary unit and metering the concentrated liquid additive to the reservoir as shown in U.S. Pat. Nos. 3,094,134 to G. C. Curries and 3,430,823 to V. L. Hunsaker both of whom show progressive automatic introduction of tablets to the dissolving container; or by dissolving dry material in a container through which the water supply passes as shown in U.S. Pat. Nos. 2,709,522 to S. C. Osborne, 2,874,032 to R. L. Kuehner, and 3,126,427 to L. N. Broughton; or by automatically periodically introducing liquid anti-mineral chemicals from large storage tanks or carboys as taught by U.S. Pat. Nos. 2,859,766 to H. L. Shuldener and 3,196,892 to R. H. Savage et al. Most of the central units require an automatic water supply and controls and apparatus not found in room humidifiers and, while satisfactory for central units, often require dismantling or adjustments in fixed equipment and are relatively expensive.

The present invention was developed to provide a convenient and easy way to dispense a water treatment liquid such as liquid "LIME OUT" or other desired water treatment liquids to the water reservoir of a room humidifier and to do so in a manner which will be acceptable to and used by the owner of such humidifiers.

As a solution to the problem, this present invention incorporates, in a humidifier assembly, a readily removable and refillable unit with an auxiliary supply of liquid water treatment within its own convenient dispensing container. The unit is incorporated as an auxiliary attachment to a humidifier with its operating portion accessible from the exterior of the top wall of the humidifier housing. The preferred way to accomplish the desired function and convenient utilization is to provide a simple refillable dispensing bottle with a cap carried poppet valve, the unit being inverted and slipped vertically into the humidifier and having provisions enabling an operator, by a simple depression on the accessible end of the inverted bottle, to cause operation of the dispensing valve to dispense a desired portion of the liquid treatment material into the humidifier water container.

This same type of simple hand manipulated dispenser unit while developed specifically for room console type room humidifiers can be readily incorporated in central heating system and other humidifiers.

SUMMARY OF THE INVENTION

A primary object of the present invention resides in the provision of a readily removable and refillable dispenser unit enabling a convenient and easy method of dispensing a liquid water treatment material such as an anti-lime agent or other material to the water supply bucket or reservoir of a humidifier.

A further object of this invention resides in the provision of a refillable dispenser unit for humidifiers consisting of an elongate bottle, the base of which is shaped to aid in mounting the dispenser and is so constructed to enable ease of removal of the dispenser and the neck of which includes threads to which is removably fastened a cap carrying a spring loaded poppet type dispensing valve.

In conjunction with the foregoing object, still another object resides in the combination in a humidifier of such a dispenser mounted in inverted relationship through the top wall of the humidifier so that the operating stem of the cap carried poppet valve has an operative engagement with an abutment component mounted on an interior support section of the humidifier housing and so located that the valve dispenses fluid into the humidifier water bucket. The valve operation can be accomplished by rigidly affixing the abutment component and depressing the bottle to open the valve or by rigidly affixing the bottle to the humidifier structure and moving the abutment to depress the poppet valve. In conjunction with the foregoing combination, the abutment component can be an apertured funnel shaped abutment unit secured to an interior portion of the humidifier providing a drain into the water reservoir and serving as a support for the dispenser unit.

In further conjunction with the combinations denoted in the foregoing objects, additional objects reside in the provision of structure on the base or bottom of the bottle which includes side lugs enabling cooperation with structure in the top wall of the humidifier which permits vertical sliding movement of the bottle or, upon rotation of the bottle, blocking or locking the bottle against vertical shift in at least in one direction; such structure made with a finger grip for rotating and or raising and removing the dispenser from its assembled location in the humidifier.

Further novel features and other objects of this invention will become apparent from the following detailed description, discussion and the appended claims taken in conjunction with the accompanying drawings.

BRIEF DESCRIPTION OF THE DRAWINGS

A preferred as well as an alternate structural embodiment of this invention is disclosed in the accompanying drawings in which:

FIG. 5 is an enlarged detail top view showing the base end of the dispenser flush with and accessible at the top surface of the humidifier cabinet;

FIG. 6 illustrates the manner in which dispensing can be accomplished by pressing on the base end of the dispenser;

FIG. 7 is an exploded and partially sectioned elevation view of components of the dispenser unit including the poppet valve in the bottle cap, the unit being illustrated in its operative inverted position;

FIGS. 8 and 9 are detail views of the special base end cap to be secured on the base of the bottle shown in FIG. 7;

FIG. 10 is a section taken on line 10—10 of FIG. 11 to illustrate the guide slot and abutment formations in the special dispenser panel;

FIG. 11 is a plan view of the dispenser panel;

FIG. 12 is a detail view of one of the internal guide slot and abutment formations in the dispenser panel, looking in the direction of line 12—12 in FIG. 11;

FIG. 13 is a top view of the funnel shaped dispenser abutment unit;

FIG. 14 is a section view taken on line 14—14 of FIG. 13; and

FIG. 15 is a diagrammatic view illustrating an alternative manner of mounting the dispenser so its valve can be manipulated by a push button and linkage arrangement.

DESCRIPTION OF THE PREFERRED EMBODIMENT

Figure 1:
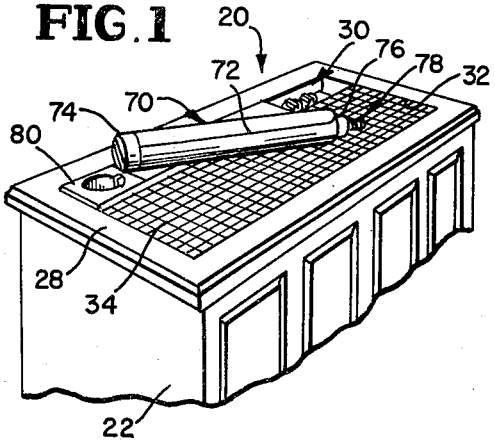
FIG. 1 is a front top quarter view partially illustrating a console room humidifier having provision for a removable dispenser unit to be mounted in the left rear corner, the dispenser unit being illustrated out of and placed on the top grid of the humidifier.

The removable dispenser unit for introducing a liquid water treatment fluid into a humidifier water reservoir can be adapted for installation in conjunction with the water reservoir of most humidifiers, however it was developed for use with and is described in combination with a room type console humidifier, an example of which can be seen in application Ser. No. 790,012 now U.S. Pat. No. 4,112,015 to T. E. Tinsler for Humidifier Drive System.

Such a console humidifier 20, FIGS. 1 through 4, consists of an open back cabinet 22 having front, side, bottom and top walls. The illustrated cabinet 22 can be molded from plastic as a unit whose bottom wall or shelf 24 supports the water reservoir 26. Its top wall 28 provides suitable panels, usually toward the rear, where humidifier controls 30 are located, and a large access opening 32 across its forward portion. Opening 32 provides access to the rotating media member for removal and replacement and also serves as an outlet for air flow, being covered by one or more open grill panels 34 to permit outlet passage of humidified air with deflection control as desired.

Within the cabinet (FIGS. 3 and 4) is a relatively large diameter media wheel 36 carrying a porous media belt 38 and suspended on grooved rollers, one of which is ordinarily a friction drive roller, as shown at 40. Media wheel 36 is arranged to rotate with a lower sector always disposed within the water reservoir 26. The grooved rollers are disposed on the front side of and are mounted on an upright panel 42 of an interior support housing 44 which may also support idler rollers (not shown) to maintain the media wheel in a vertical attitude, as it rotates.

A central opening or plenum 46 is provided in panel 42, surrounding a fan 48 driven by electric motor 50 which, in turn, is mounted via support members 52 to the housing 44. The media wheel 36 is slowly rotated by drive roller 40 driven by motor 50 through a high speed reduction belt and pulley drive system, generally denoted at 54. Motor 50 is powered and controlled via leads from a power source and suitable controls 30, which may include multi-speed controls, an automatic humidistat and an on-off control. In addition, the controls may include a water level indicator or refill indicator light for signalling the amount of water in the reservoir.

During operation, the fan draws air in from the rear of the unit, passes the air through the plenum opening to the interior of and directed against the inner surface of the media wheel, which diverts the air flow through the porous media belt 38 which is continuously wetted as it rotates through the water reservoir 26. The air becomes moisture laden as it passes through belt 38 and thence through the top wall which directs the humidified air into the room or enclosure where the humidifier is placed.

Figure 2:
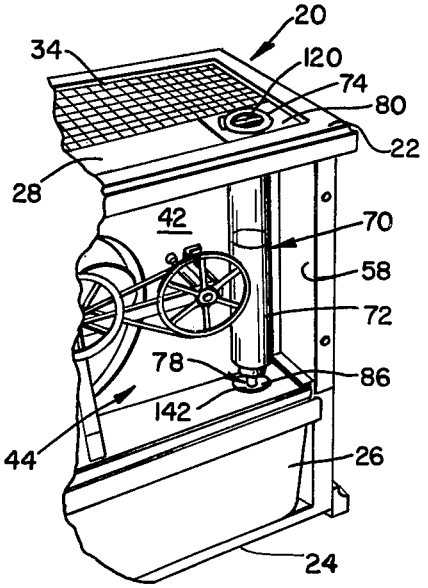
FIG. 2 is a partial perspective rear upper quarter view of the humidifier shown in FIG. 1, illustrating the dispenser in its assembled location in the humidifier.
Figure 3:
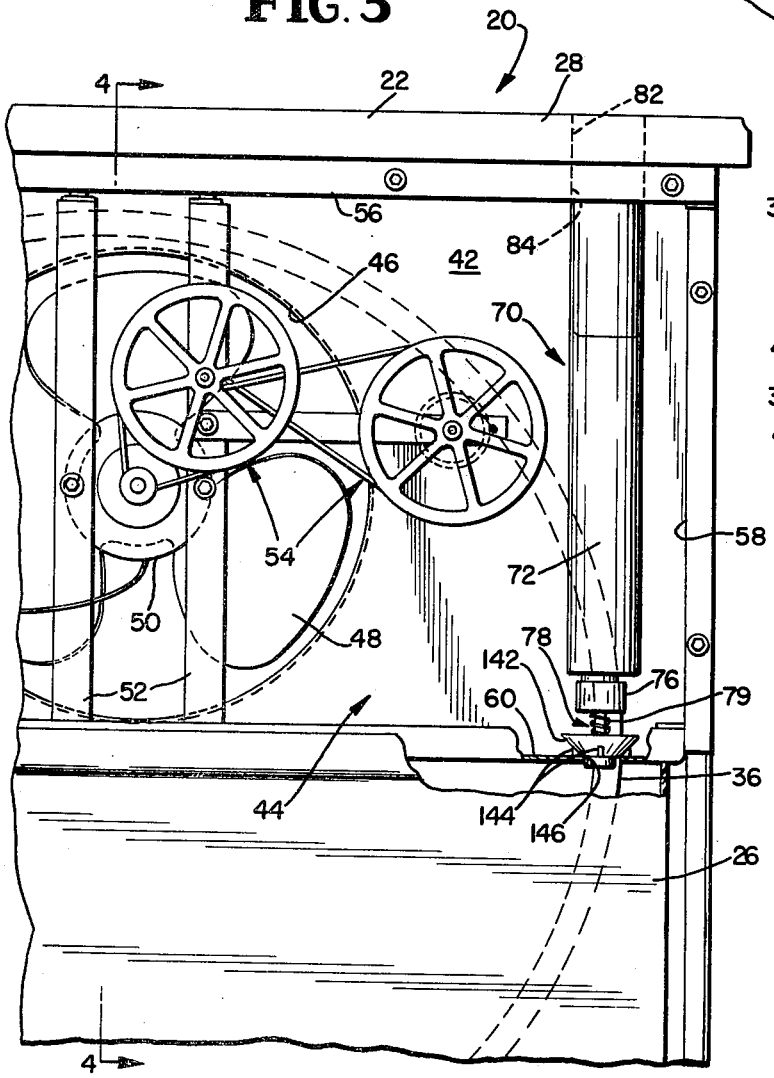
FIG. 3 is a partial elevation view, with a portion sectioned, looking at the right upper rear of the humidifier.
Figure 4:
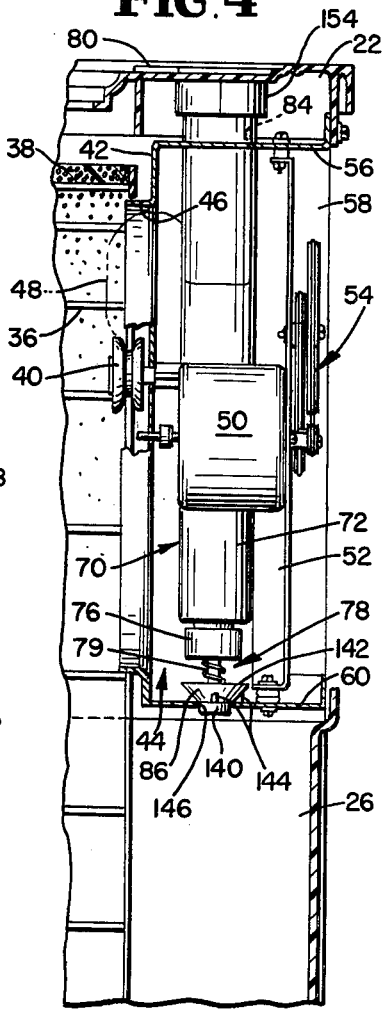
FIG. 4 is a partially broken section view taken on line 4—4 of FIG. 3 to illustrate further relationship between the dispenser and the other humidifier components.

With reference to FIGS. 2, 3 and 4, interior support housing 44 is a separate intermediate section usually made from sheet metal with peripheral top 56, side 58, and bottom 60 walls which, with the main panel 42, provide a rigid box like structure. The edges of the side and top walls of the support housing 44 have bent attachment flanges which rest against and are secured, as by screws, to the rear edges of the console cabinet. So assembled the top wall of the support housing is under the rear portion of and close to the under surface of the cabinet top wall 28. Its lower horizontal wall 60 is located intermediate the top and bottom of the cabinet and the water reservoir 26, which is a plastic tray or bucket, can be slid into place on the bottom shelf 24 of the cabinet and under the lower wall 60 of the interior housing.

Most room humidifiers have basic components somewhat similar to those described in the foregoing paragraphs and many of the central home humidifiers have somewhat equivalent components such as the housing, interior support structure and a water reservoir located at or near the lower part of the humidifier. In such humidifiers there is usually space and existing structure which can accommodate and be utilized for receiving a removable liquid water treatment dispenser in accord with the present invention.

In the humidifier structure illustrated in FIGS. 1–4 the liquid water treatment dispenser 70 is an elongate bottle 72 with a base unit 74 and a cap 76 which includes a spring loaded poppet valve 78 (see FIG. 7) having a projecting stem 79. As seen in FIG. 1, a small panel insert 80, securely mounted in a cutout at the rear corner of the console top wall 28, has an opening 82 into which the dispenser unit can be inserted, cap end down. The inverted dispenser 70 fits with a free sliding fit through the insert opening 82, through a second opening 84 (FIG. 4) in the top wall 56 of the interior housing and will slide down to its assembly location where the end of the valve stem 79 abuts a special shaped drain unit 86 (to be described hereinafter) secured in the lower wall 60 of the interior housing above the reservoir tray 26. As shown in FIGS. 2–4, so inserted, the weight of the dispenser is supported on its valve stem 79 and is maintained in vertical disposition by its cooperative fit through the panel insert opening 82. The length of the dispenser will be such that, in assembly, its base end surface will be flush with the upper surface of the console top rear panel. The bias force of the spring in poppet valve 78 is sufficient to support a filled dispenser unit without causing unintentional opening of the poppet valve. So positioned, fluid can be dispensed by pressing down on the base of the dispenser unit (FIG. 6) causing the poppet valve 78 to open and permit fluid to pass from the dispenser through the drain 86 into the reservoir 26. Releasing the downward pressure permits the dispenser to move, under valve spring bias force, up to its rest position and the valve will close.

FIG. 7 shows the components of the dispenser 70 in exploded view and partially sectioned. The bottle 72 is preferably transparent or semi-transparent and can be made from glass or plastic and is tubular with a threaded neck 90 at one end and a closed base end 92, circumferentially stepped at 94 and including a short integral projecting lug 96.

The cap 76 is internally threaded at 98 to mate with and fit the threaded neck 90 on bottle 72 and carries a flat washer-like seal 100 which is clamped and provides a seal between the cap 76 and the bottle neck. The hole 102 in the washer seal 100 is aligned with a central aperture 104 in cap 76 permitting the stem 70 of the poppet valve to be inserted through the openings from within the cap. Stem 79 has an integral flanged head 106 which can abut the washer seal and provide a sealed valving closure of the cap aperture 104. To bias the poppet valve 78 to a closed position, a coil compressor spring 108 is placed over the valve stem 79 with one end abutting the outside of the cap 76 and is held in place on the stem by contact with a C-clip 110 fitted into a groove adjacent the end of the valve stem. Poppet valve 78 may be moved to an open position by moving the stem 79 inward against the force of spring 108. To permit a free flow of liquid from the bottle, stem 79 can be longitudinally grooved as at 112 (FIG. 7). The cap and valve can be removed as a unit to permit filling the bottle through its neck.

A base unit 74 is secured to the bottle 72 to provide several functions, i.e., it serves as a guide, provides locking or blocking and includes a small handle to aid in rotary manipulation as well as removal of the dispenser unit. Base 74 (FIGS. 7, 8 and 9) is preferably molded from plastic and is essentially cylindrical with a midwall 118 and an external cross bar 120 providing a finger grip handle for rotating and lifting the dispenser. The underside of cross bar 120 is hollow providing a recess 122 into which the projected bottle base lug 96 and a U-clip 124 are fitted with the skirt 126 of base unit disposed over the stepped bottom end 94 of bottle 72. So assembled, the cylindrical configuration of the base unit 74 provides a continuation of the cylindrical contour of the bottle. Metal U-clip 124 fits over the lug 96 and into depressions 128 in the sides of the lug so when the lug and clip are pressed into the base unit recess 122, friction force will hold the components in assembly. To assure secure assembly, an adhesive can be placed on the lug or in the recess before the base unit is forced onto the bottom of the bottle.

Looking at FIGS. 5, 6, 8 and 9, dispenser base unit 74 has two diametrical side lugs 130 and 132. As will become apparent, the lugs are utilized in conjunction with formations in the dispenser panel insert 80 to provide a means in one position for blocking (locking) the dispenser against inadvertent dispensing and in another position to enable depression of the dispenser to permit flow of a desired small amount of water treatment material into the humidifier reservoir.

As was hereinbefore described, the dispenser 70 is vertically supported by abutment of the end of poppet valve stem 79 on a drain component 86 located in or on the lower wall 60 of the interior humidifier housing. In the preferred embodiment, the drain 86 is made from plastic as a separate unit attached to and providing a fluid flow passage through the lower interior housing wall 60. The drain has an apertured wall 138, a short depending circular sleeve portion 140 and an upper section formed as a divergent frustum or funnel section 142. Integrally molded on the exterior are several triangular abutments 144 which, when unit 86 is mounted with the depending cylindrical sleeve fitting through a circular opening 146 in wall 60 above the reservoir space, will abut the top surfaces of wall 60. Drain unit 86 can be secured in assembly by use of a circular star clip on sleeve 140 or the bottom edge of the plastic skirt or sleeve 140 can be deformed outward, as by heat, to engage the underside of wall 60 around the opening 146. Alternatively, the drain can be made structurally integral with the lower wall, e.g., lower wall 60 if made from sheet metal could be deformed (not shown) at the desired drain location into a small funnel-like depression with pierced openings similar to the drain openings 148 in the drain unit 86.

The upper funnel shaped skirt 142 helps to guide and locate the dispenser valve stem to an abutment over the drain openings as well as assuring that dispensed liquid will be trapped by and directed through the drain to the reservoir.

As illustrated, panel insert 80 is a separately made escutcheon-like part fastened to the console cabinet, as by adhesive or other suitable means, and cooperates with the special dispenser base unit 74 to provide two dispenser conditions, a locked condition and an operative condition. Panel insert 80 is molded with an integral top plate 152 and a dependent, essentially cylindrical receptacle sleeve 154 and formed in the internal surface of the sleeve 154 are diametrically located recesses 156 shaped as shown in layout drawing FIG. 12. Each of the recesses have two vertical grooves 158 and 160, groove 158 being longer than groove 160 and each groove having a lower end abutment 162 and 164 respectively. The dispenser 70 is slipped into sleeve 154, the poppet valve stem will abut the drain 86 when the two base unit side lugs 130 and 132 slip into the diametrical recesses 156. The dispenser can be rotated through an approximate 45° whereupon to align the base unit side lugs 130 and 132 either with the set of long grooves 158 or the set of short grooves 160. Viewing FIG. 12, when the lugs are positioned in alignment with the long grooves 158 of the recesses they will normally be disposed as illustrated by position A, their rest disposition determined by abutment of the poppet valve stem on drain unit 86. In this position the dispenser can be physically depressed until the base unit side lugs engage the bottom abutments 162 of long grooves 158 whereat the poppet valve spring is compressed and the poppet valve opens to permit liquid to flow from the dispenser into the reservoir. Releasing pressure on the base of the dispenser permits the poppet valve spring to move the dispenser upward to a valve closed condition. To prevent inadvertent dispenser operation, the dispenser 70 can be rotated by finger handle 120 to place base unit side lugs into the phantom line position B of FIG. 12, whereat they are aligned with and will abut the bottom abutments 164 of the short grooves 160. In this condition dispenser 70 cannot be pressed downward, it is blocked from or locked against dispensing operation.

An alternate manner of removably mounting a refillable dispenser unit in a humidifier is illustrated in FIG. 15. In such embodiment, the dispenser unit 170 can be constructed essentially the same as unit 70 but is inserted in the humidifier cabinet 172 through a different panel insert 180 which will include bayonet type lock formations 182 under which the lugs on the dispenser base unit 174 will rotate to lock the dispenser against up and down vertical movement. The valve unit 178 will be oriented immediately above a funnel like abutment 184 located on one arm of a double arm lever 186 pivoted at 188 on fixed humidifier structure 190 above the reservoir 192. The other arm of lever 186 is pivotally connected to the lower end of a plunger rod 194 which projects up through the top wall of the humidifier cabinet and terminates in an actuator push knob 196. The inactive condition of the operating linkage can rely on the bias of the valve spring 198 or a supplemental compression coil spring 200 can be included between knob 196 and the top wall of the humidifier. The funnel abutment 184 will be situated adjacent and aligned above an opening in humidifier structure to permit through flow of liquid from the dispenser to the reservoir whenever the knob 196 is depressed.

The invention may be embodied in other specific forms without departing from the scope, spirit or essential characteristics thereof. The present embodiments are, therefore, to be considered in all respects as illustrative and not restrictive, the scope and spirit of the invention being indicated by the appended claims rather than by the foregoing description, and all changes which come within the meaning and range of equivalency of the claims are, therefore, intended to be embraced therein.

What is claimed and desired to be secured by Letters Patent is:

1. In combination in a humidifier having a water supply reservoir: a refillable, removable auxiliary liquid treatment container with a removable closure means at its outlet end removably mounted in the humidifier in inverted position with its outlet end disposed for controlled flow communication into the water reservoir, a normally closed valve means located in the closure means of said container including an operable means enabling controlled manipulation of said valve means for opening said valve means and dispensing a desired amount of liquid treatment material.

2. In combination with a humidifier having support structure, a water supply reservoir and means to utilize water from said reservoir to humidify air, a readily removable and refillable dispenser unit for dispensing a liquid water treatment material, such as an anti-lime agent, into the water reservoir; said dispenser unit comprising a container with a removable closure cap means including dispensing valve means normally biased to a closed non-dispensing position; means on said humidifier structure and said dispenser unit enabling removably mounting said dispenser unit in the humidifier with the valve means located to enable gravity fed fluid flow communication from the dispenser unit into the reservoir when the valve means is opened; and means selectively operable on said valve means to open said valve means in opposition to said bias force for selectively dispensing a desired quantity of liquid treatment material into said reservoir.

3. A humidifier comprising: a water supply reservoir; a media unit which passes through the reservoir and picks up moisture; a fan; drive mechanism with motor means connected to drive and move the media unit and said fan for blowing air through the moistened media unit into the surrounding area; an auxiliary, removable liquid water treatment dispenser comprising a liquid container having a filler neck at one end with removable cap means on said filler neck; said dispenser being removably mounted in the humidifier disposed in inverted disposition in a position to enable fluid communication with the water reservoir; said cap means including valve means normally biased to a closed position; and operating means for opening said valve means against its normally closed condition to enable controlled dispensing of a liquid water treatment material from said dispenser into said water reservoir.

4. A humidifier as defined in claim 3, wherein said valve means is a spring biased valve, biased to closed condition, included in said cap means, said valve has a projecting stem, and an apertured drain means is carried by said humidifier immediately above said water reservoir; and, in assembly within the humidifier, said auxiliary dispenser is mounted in inverted position with said stem abutting the apertured drain means.

5. A humidifier as defined in claim 4, wherein said valve is a poppet valve and said operating means includes means providing relative movement between said dispenser cap means and said projecting valve stem to move said poppet valve means to open position against the biased closing force and permit a desired period of dispensing of liquid from said dispenser into said water reservoir.

6. A humidifier as defined in claim 5, wherein the base end of said inverted dispenser is accessible from the exterior of said humidifier to enable removal of the dispenser without displacement of other humidifier components.

7. A humidifier as defined in claim 6, wherein cooperating structural means on said dispenser and on said humidifier structure enables inverted removable mounting of said dispenser and also provides for vertical movement of said dispenser into and out of said humidifier.

8. A humidifier as defined in claim 7, wherein said dispenser in normal disposition is locked against vertical movement by said cooperating means and said operating means includes a linkage means which can move said apertured drain means to abut and move said valve operating stem against the spring biased valve closing force and permit a desired period of dispensing of liquid from said dispenser into said water reservoir.

9. A humidifier as defined in claim 7, wherein said dispenser, in its normal mounting is positioned with said valve operating stem abutting and supporting said dispenser on said apertured drain means, and said cooperating means which enables removable mounting of the inverted dispenser permits a supplemental increment of downward movement whereby a manual downward pressure on said base will depress said dispenser to thereby move said poppet valve means against the spring biased force and permit a desired period of dispensing of liquid from said dispenser into said water reservoir.

10. A humidifier as defined in claim 2, wherein said drain means comprises a small funnel like flow communication device with its smaller end made as an apertured abutment and secured in the aperture of said horizontal partition.

11. A humidifier as defined in claim 2, wherein the base end of said dispenser includes at least one lateral lug, said means providing an opening in the top wall of said housing includes a recess in the side wall of the opening with two vertical slots accommodating said lateral lug and enabling vertical sliding movement of said dispenser when said dispenser is rotatably oriented so that said lug is aligned with one of said one slot and having a lower end abutment against which said lateral lug will abut when said auxiliary container is rotated to a locked position to thereby prevent supplemental depression of said auxiliary container for dispensing.

12. A humidifier as defined in claim 11, wherein said dispenser base end further includes a manual handle enabling means to rotate and to lift said dispenser.

13. A console type humidifier having a housing; an internal support structure with a horizontal partition; a water supply bucket removably inserted into said housing in the space below said partition; a media unit mounted for rotation on said support structure so it passes through the water bucket; a motor driven fan unit with drive mechanism for rotating the media unit for blowing air through said media unit and into the surrounding area; means providing a dispenser receptacle opening through a portion of the top wall of said housing; fluid communication means providing flow passage means through said horizontal partition located in vertical alignment below the opening in said top wall; a liquid water treatment dispenser container disposed in said receptacle, said container being closed at one end and having a filler neck at the other end with a removable cap means secured to said other end; a poppet valve means projecting from the cap means with spring means biasing the valve means to a valve closed position whereby movement of said stem against spring bias and toward said container operates said valve means to its opened position; the circumference of said container being dimensioned to slidably fit and be guided through the opening in said top wall so that said container in inverted disposition can be removably placed into said humidifier through said opening with its valve stem resting on the fluid communication means in said partition; the length of said container being sufficient so that when placed into the receptacle the container base end surface will be substantially parallel with the outer surface of said top wall enabling an operator to press down on the base end of said container to operate said valve means to open a fluid flow path from inside the container to and through the fluid communication means and thence to the water supply bucket.

14. A humidifier as defined in claim 13, wherein said receptacle opening is a cylindrical sleeve and said container is cylindrical and fits within said sleeve with a free sliding fit.

15. A humidifier as defined in claim 14, wherein cooperating structure in the wall of said receptacle opening end on said container enables selective rotational location of said container in said opening to permit or block dispensing operation.

16. A humidifier enclosed in a housing comprising: a water supply reservoir; a media unit which passes through the reservoir and picks up moisture; a fan; drive mechanism with motor means connected to drive and move the media unit and said fan for blowing air through the moistened media unit into the surrounding area; and an auxiliary, removable liquid water treatment dispenser comprising a container having a filler neck at one end with removable cap means on said filler neck; said dispenser being removably mounted in the humidifier disposed in inverted disposition in a position to enable fluid communication with the water reservoir; said cap means including a spring biased valve, with a stem projecting from said cap means, normally biased to a closed position; and operating means for operating said valve against its normally closed condition to enable controlled dispensing of liquid treatment material from said dispenser into said water reservoir; an apertured drain means carried by said humidifier immediately above said water reservoir; said auxiliary dispenser, in assembly within the humidifier, being mounted in inverted position with said stem abutting the apertured drain means; said housing enclosing said humidifier having a top wall; an internal support structure provides a mounting for said media unit, drive mechanism and fan and further providing a horizontal partition above a water reservoir space; said housing top wall having a through opening into which said dispenser can be mounted in said inverted position; said horizontal partition has an aperture aligned vertically below said top wall opening which contains said apertured drain means, and said dispenser being of such length that when assembled into a humidifier with the valve operating stem resting on said drain means, its base end is guided within the housing top wall opening with the base surface of said base end accessible to an operator for depressing the dispenser for dispensing.

* * * * *